US009095741B1

(12) United States Patent
Maresh et al.

(10) Patent No.: US 9,095,741 B1
(45) Date of Patent: Aug. 4, 2015

(54) EXERCISE METHODS AND APPARATUS

(76) Inventors: Joseph D. Maresh, West Linn, OR (US); Kenneth W Stearns, Houston, TX (US)

( * ) Notice: Subject to any disclaimer, the term of this patent is extended or adjusted under 35 U.S.C. 154(b) by 15 days.

(21) Appl. No.: 13/410,259

(22) Filed: Mar. 1, 2012

Related U.S. Application Data

(60) Provisional application No. 61/464,226, filed on Mar. 1, 2011.

(51) Int. Cl.

| | |
|---|---|
| ***A63B 22/00*** | (2006.01) |
| ***A63B 22/04*** | (2006.01) |
| ***A63B 71/00*** | (2006.01) |
| ***A63B 22/06*** | (2006.01) |

(52) U.S. Cl.
CPC ..... *A63B 22/0664* (2013.01); *A63B 22/001* (2013.01); *A63B 22/0015* (2013.01); *A63B 2022/0017* (2013.01); *A63B 2022/067* (2013.01); *A63B 2022/0676* (2013.01); *A63B 2022/0682* (2013.01)

(58) Field of Classification Search
CPC ..... A63B 22/001; A63B 22/0664; A63B 2022/067; A63B 22/0015; A63B 2022/0017; A63B 2022/206; A63B 2022/0676; A63B 2022/0682; A63B 2022/0688
USPC ..... 482/51–78
See application file for complete search history.

(56) References Cited

U.S. PATENT DOCUMENTS

| | | | | |
|---|---|---|---|---|
| 5,895,339 | A | 4/1999 | Maresh | |
| 5,919,118 | A * | 7/1999 | Stearns et al. | 482/51 |
| 5,924,963 | A | 7/1999 | Maresh et al. | |
| 5,997,445 | A | 12/1999 | Maresh et al. | |
| 6,080,086 | A * | 6/2000 | Maresh et al. | 482/57 |
| 6,206,804 | B1 | 3/2001 | Maresh | |
| 6,217,485 | B1 | 4/2001 | Maresh | |
| 6,248,046 | B1 | 6/2001 | Maresh et al. | |
| 6,312,362 | B1 | 11/2001 | Maresh et al. | |
| 6,361,476 | B1 * | 3/2002 | Eschenbach | 482/52 |
| 6,416,442 | B1 * | 7/2002 | Stearns et al. | 482/52 |
| 6,540,646 | B2 * | 4/2003 | Stearns et al. | 482/52 |
| 6,544,146 | B1 | 4/2003 | Stearns et al. | |
| 6,565,486 | B2 * | 5/2003 | Stearns et al. | 482/52 |
| 6,569,061 | B2 | 5/2003 | Stearns et al. | |
| 6,645,125 | B1 * | 11/2003 | Stearns et al. | 482/52 |
| 6,672,994 | B1 | 1/2004 | Stearns et al. | |
| 7,025,711 | B2 * | 4/2006 | Eschenbach | 482/52 |
| 7,033,305 | B1 * | 4/2006 | Stearns et al. | 482/52 |
| 7,918,766 | B2 * | 4/2011 | Lu et al. | 482/52 |
| 2002/0032104 | A1 * | 3/2002 | Rosenow et al. | 482/52 |
| 2005/0043148 | A1 * | 2/2005 | Maresh | 482/70 |
| 2005/0187073 | A1 * | 8/2005 | Krull et al. | 482/72 |
| 2006/0247103 | A1 * | 11/2006 | Stearns et al. | 482/52 |
| 2010/0204017 | A1 * | 8/2010 | Uffelman | 482/52 |

* cited by examiner

*Primary Examiner* — Oren Ginsberg
*Assistant Examiner* — Joshua Lee
(74) *Attorney, Agent, or Firm* — Nick A. Nichols, Jr.

(57) ABSTRACT

An elliptical motion exercise apparatus may provide a novel linkage assembly suitable for linking circular motion to relatively more complex, generally elliptical motion. Left and right cranks may be rotatably mounted on a frame. A force receiving member may be movably connected between a handle bar rocker and left and right crank assemblies in such a manner that the force receiving member moves through paths of motion which are fixed, adjustable or variable.

3 Claims, 6 Drawing Sheets

EXERCISE METHODS AND APPARATUS

CROSS-REFERENCE TO RELATED APPLICATION

This application claims the benefit of U.S. Provisional Application Ser. No. 61/464,226, filed Mar. 1, 2012, which application is incorporated herein in its entirety by reference.

BACKGROUND

The present invention relates to fitness machines, and in particular a fitness machine which constrains the user's foot and/or arm to travel along a variable or fixed foot path.

Exercise equipment has been designed to facilitate a variety of exercise motions (including treadmills for walking or running in place; stepper machines for climbing in place; bicycle machines for pedaling in place; and other machines for skating and/or striding in place. Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, room for improvement remains.

SUMMARY

An elliptical motion exercise apparatus may provide a novel linkage assembly suitable for linking circular motion to relatively more complex, generally elliptical motion. Left and right cranks may be rotatably mounted on a frame. A force receiving member may be movably connected between a handle bar rocker and left and right crank assemblies in such a manner that the force receiving member moves through paths of motion which are fixed, adjustable or variable.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
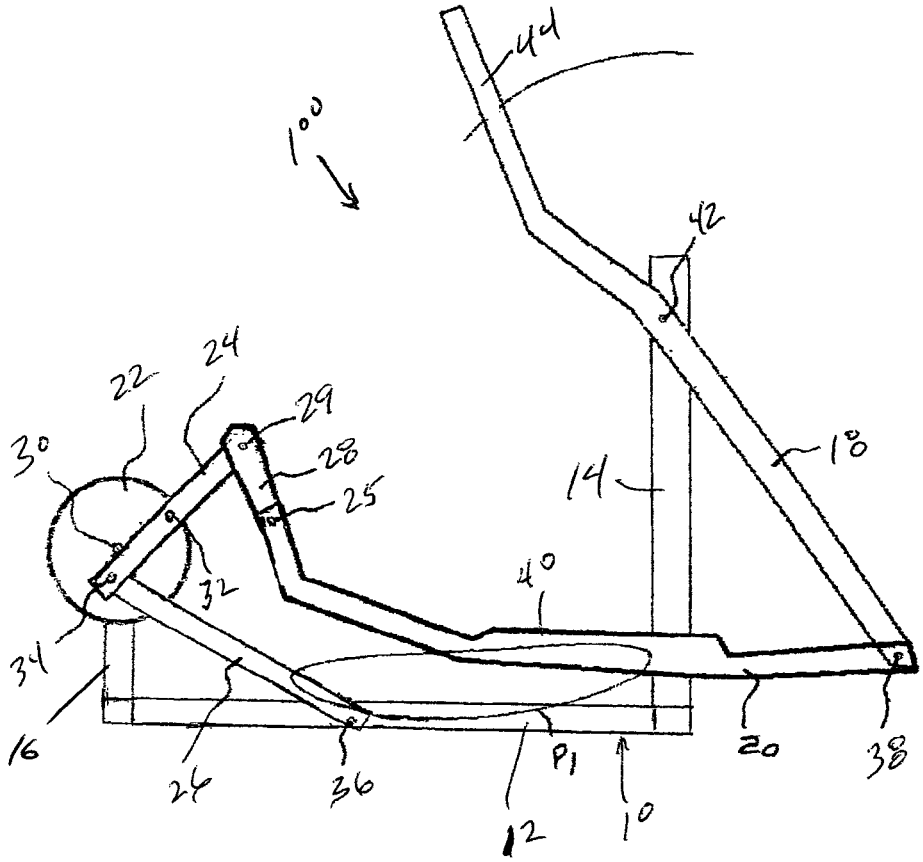
FIGS. 1, 2 and 3 depict a side view of an embodiment of an exercise apparatus illustrating a relatively large range of motion in a closed path.

Elliptical motion exercise apparatus may link rotation of left and right cranks to generally elliptical motion of respective left and right foot supports. The term "elliptical motion" is intended in a broad sense to describe a closed path of motion having a relatively longer major axis and a relatively shorter minor axis. In general, displacement of the cranks move the foot supports in a direction coincidental with one axis of the elliptical path, and displacement of crank driven members move the foot supports in a direction coincidental with the other axis. A general characteristic of elliptical exercise apparatus may be that the crank diameter determines the length of one axis, but does not determine the length of the other axis. As a result of this feature, a user's feet may travel through a generally elliptical path having a desirable aspect ratio, and the apparatus that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. Like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

Referring first to FIG. 1, an embodiment of an elliptical exercise apparatus is generally identified by the reference numeral 100. The apparatus 100 includes a frame 10 that is designed to rest upon a floor surface. The frame 10 may include a generally I-shaped base 12. A forward stanchion 14 extends upward from a forward end of the base 12 and a rearward stanchion 16 extends upward from the base 12 proximate an opposite, rearward end of the base 12.

A linkage assembly may be movably mounted on the frame 10. On each side of the apparatus 100, the linkage assembly may include a handle bar rocker 18, a force receiving member 20 and a crank assembly that may include a crank 22, a connector link 24, a rocker link 26 and a sinking crank 28. The crank 22 is keyed to a common shaft rotatably mounted on the rear stanchion 16 at bearing 30 by means known in the art. The connector link 24 is pivotally connected to the crank 22 at a radially displaced pin 32 secured to the crank 22. A first end of the connector link 24 is rotatably connected to the rocker link 26 at bearing 34. The opposite end of the rocker link 26 is pivotally connected to the frame 12 at bearing 36. A second end of the connector link 26 is rotatably connected to the sinking crank 28 at bearing 29.

The force receiving member 20 may include a proximal end connected to the lower end of the handle bar rocker 18 at bearing 38. The handle bar rocker 18 is rotatably connected to the forward stanchion 14 at bearing 42. An upper end 44 of the handle car rocker 18 is sized and configured for grasping by a person standing on the force receiving member 20.

A distal end of the force receiving member 20 is rotatably connected to an end of the sinking crank 28 at bearing 25. The proximal end of the force receiving member 20 is constrained to move in a generally reciprocal fashion relative to the frame 12. An intermediate portion of the force receiving member 20 may be sized and configured to include a foot platform 40 to support a person's foot. Generally, the linkage assembly encourages the force receiving member 20 to travel through an elliptical path of motion having a selectively variable length.

Figure 6:
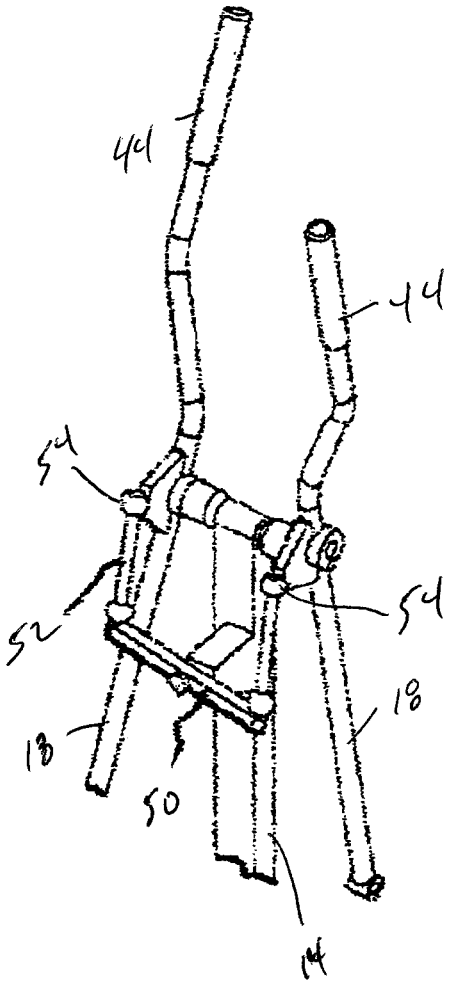
FIG. 6 depicts an enlarged perspective view of an embodiment of a cross-connect member that may interconnect the handle bar rockers of an exercise apparatus to move in dependent fashion relative to one another.

The handle bar rockers 18 may be interconnected to move in dependent fashion in opposite directions relative to one another. A cross-connect member 50, shown in FIG. 6, may be mounted on the forward stanchion 18 and rotatable relative thereto about a horizontal axis. Link members 52 or the like interconnect the right and left handle bar rockers 18 to the cross-connect member 50. The link members 52 may comprise a rigid bar having spherical joints 54 at the ends thereof. Rotational resistance in the form of friction may be provided between the stanchion 14 and the cross-connect member 50. Spring and/or damper resistance may also be provided between the cross member 50 and the stanchion 14.

Figure 2:
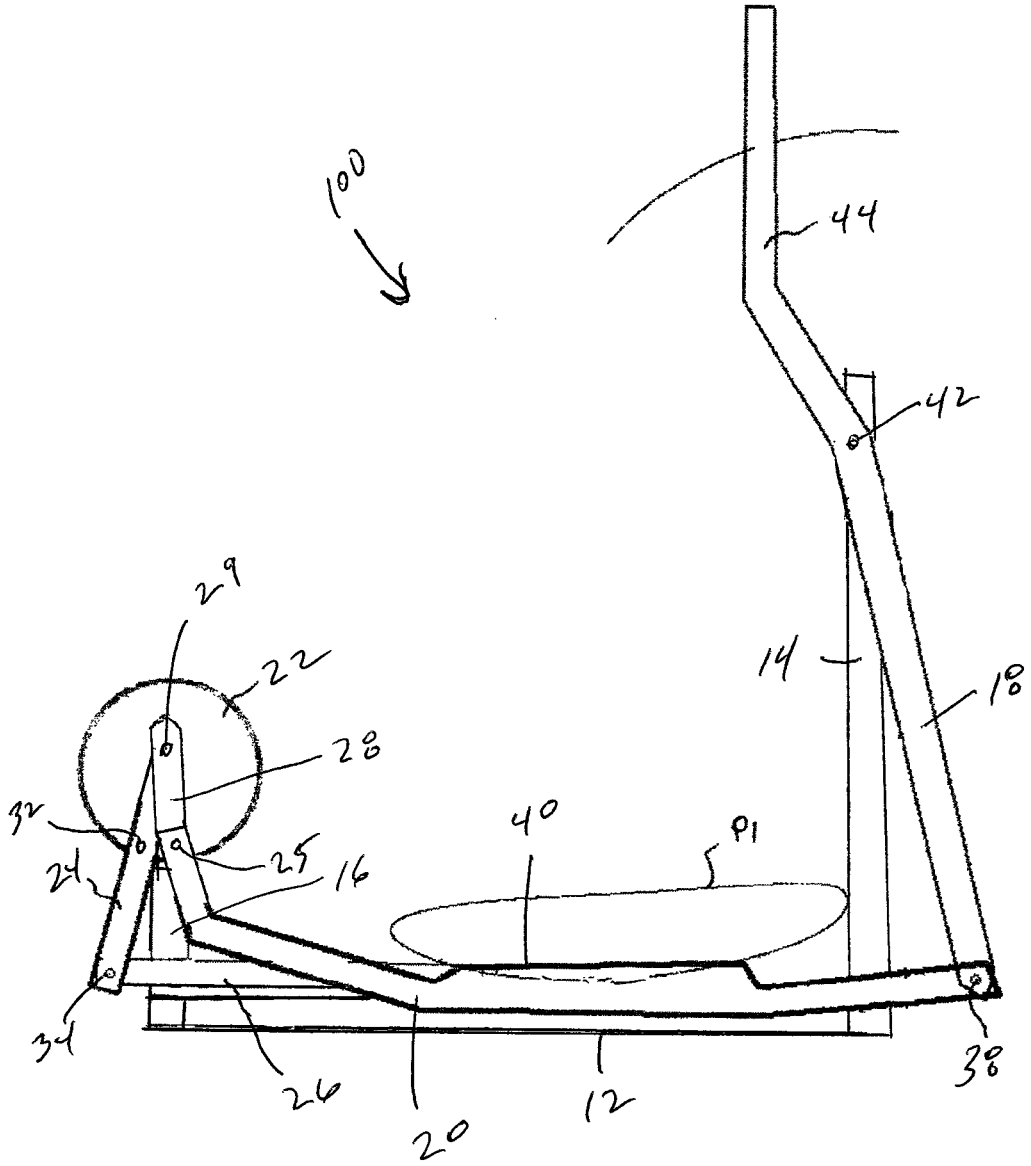
Figure 3:
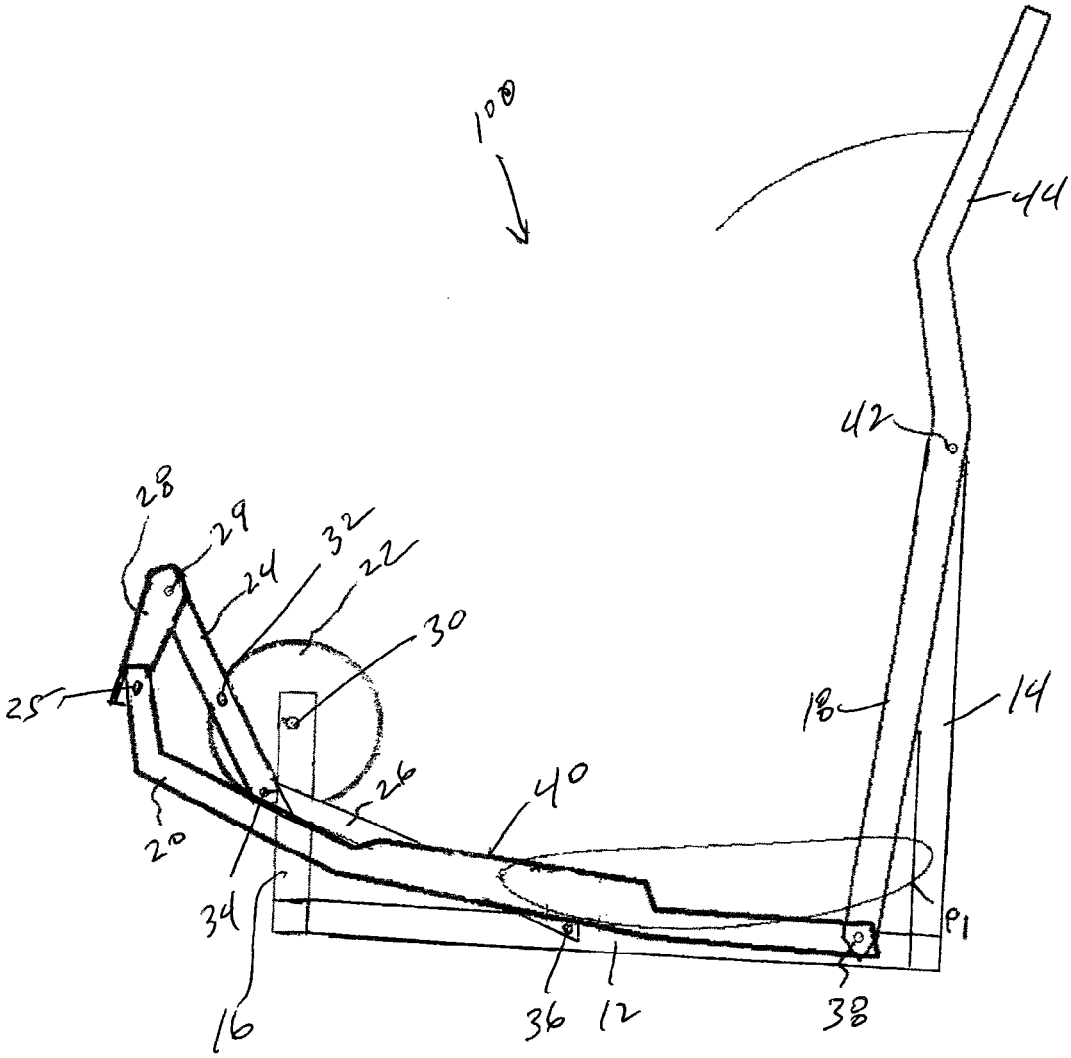
Figure 4:
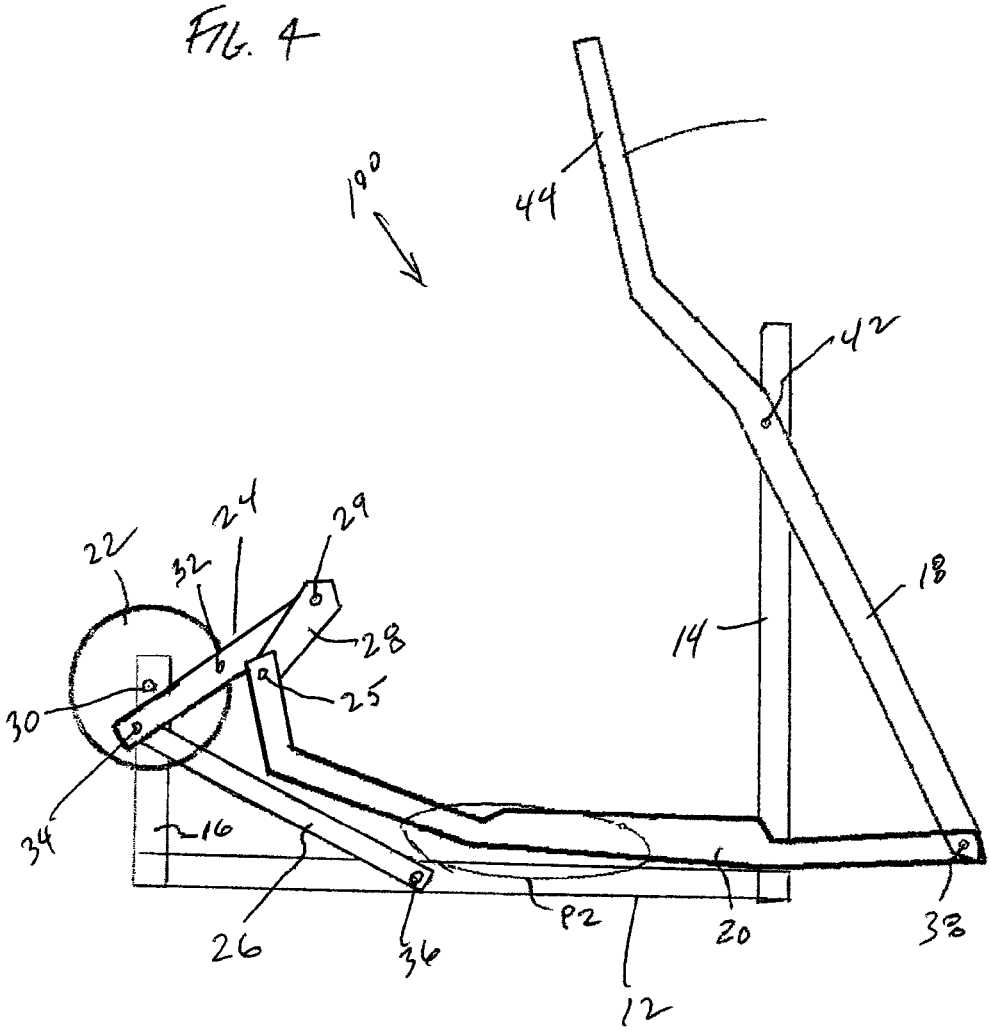
FIGS. 4 and 5 depict a side view of an embodiment of an exercise apparatus illustrating a relatively small range of motion in a closed path.
Figure 5:
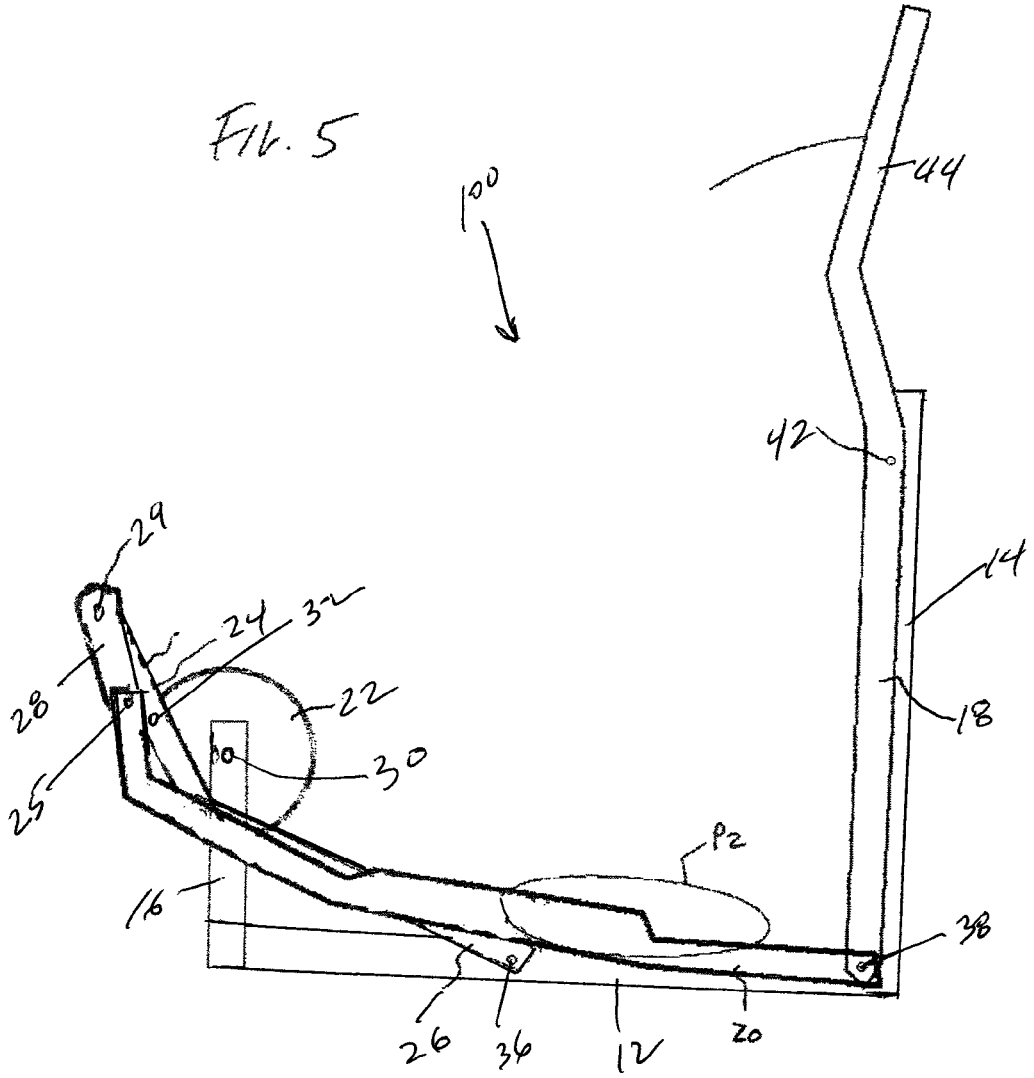

During use, a user may stand on the foot platforms 40 an initiate a walking, striding or jogging motion. The force applied by the user may be transmitted to the force receiving member 20 which may cause the sinking crank 28 to swing and may cause rotation of the crank 22. This interaction may allow variable stride closed path motion of the force receiving member 20. The sink crank 28 may swing within a range of motion in response to the user applied force transmitted to the force receiving member 20. FIGS. 1-3 depict a relatively large foot/arm range of motion allowing the foot pads 40 to travel along a relatively large path P1. FIGS. 4 and 5 depict a relatively small foot/arm range of motion allowing the foot pads 40 to travel along a relatively short path P2. If a fixed path range of motion is desired, the sinking crank 28 may be locked to the connector link 24 by means known in the art such that the foot pads may travel along a non-variable fixed path.

While a preferred embodiment of the invention has been shown and described, other and further embodiments of the invention may be devised without departing from the basic scope thereof, and the scope thereof is determined by the claims which follow.

The invention claimed is:

1. An exercise apparatus, comprising:

a) a frame configured to rest upon a floor surface;

b) a left crank and a right crank, each said crank rotatably connected to said frame;

c) a left connector link and a right connector link, each said connector link having a first distal end, an intermediate portion and a second distal end, wherein each said connector link is rotatably connected to a respective crank at said intermediate portion of said connector link;

d) a left rocker link and a right rocker link, each said rocker link including a first end portion pivotally connected directly to said first distal end of a respective said connector link and a second end pivotally connected directly to said frame;

e) a left force receiving link and a right force receiving link;

f) a left handle bar rocker and a right handle bar rocker, each said handle bar rocker mounted on a respective side of said frame, wherein a forward distal end of each said force receiving link is pivotally connected to a lower distal end of a respective said handle bar rocker;

g) a left sinking crank and a right sinking crank, each said sinking crank interconnected between said second distal end of a respective said connector link and a respective said force receiving link in such a manner allowing said force receiving link to move through a closed path of motion having a variable stride length, wherein the length of the variable stride is a function of user applied force; and h) a cross-connect member pivotally connected to said frame interconnecting said left and right handle bar rockers to move in dependent fashion in opposite directions relative to said frame.

2. An exercise apparatus, comprising:

a) a frame configured to rest upon a floor surface;

b) a first force receiving member and a second force receiving member, each said force receiving member including a foot platform fixedly secured thereon sized and configured to accommodate a person's foot;

c) first and second crank assemblies interconnected between said frame and a respective said force receiving member, wherein each of said crank assemblies includes (i) a crank that rotates about a crank axis, wherein said crank includes a connection point disposed at a radial distance from the crank axis; (ii) a connector member having a first distal end, an intermediate portion and a second distal end, said connector member rotatably connected to said crank at said connection point; (iii) a rocker link having a first end pivotally connected directly to said frame and a second end pivotally connected to said first distal end of said connector member; and (iv) a sinking crank, wherein said sinking crank includes a rearward end rotatably connected to said second distal end of said connector member and a forward end rotatably connected to a respective said force receiving member in such a manner allowing said force receiving member to move through a closed path of motion having a variable stride length, wherein the length of the variable stride is a function of user applied force; and d) first and second handle bar rocker links mounted on a respective side of said frame, each said force receiving member pivotally connected to a lower distal end of a respective said handle bar rocker link.

3. The exercise apparatus of claim 2 including a cross-connect member pivotally connected to said frame, interconnecting said first and second handle bar rocker links to move in dependent fashion in opposite directions relative to said frame.

* * * * *